US009095214B2

(12) United States Patent
White et al.

(10) Patent No.: US 9,095,214 B2
(45) Date of Patent: Aug. 4, 2015

(54) DOOR CLOSURE MECHANISM FOR REFRIGERATOR OR OTHER APPLIANCE

(71) Applicant: MANSFIELD ENGINEERED COMPONENTS, INC., Mansfield, OH (US)

(72) Inventors: Brian White, Shelby, OH (US); James Collene, Bucyrus, OH (US)

(73) Assignee: Mansfield Engineered Components, Inc., Mansfield, OH (US)

( * ) Notice: Subject to any disclaimer, the term of this patent is extended or adjusted under 35 U.S.C. 154(b) by 0 days.

(21) Appl. No.: 14/093,320

(22) Filed: Nov. 29, 2013

(65) Prior Publication Data

US 2014/0145576 A1 May 29, 2014

Related U.S. Application Data

(60) Provisional application No. 61/731,303, filed on Nov. 29, 2012.

(51) Int. Cl.

| | |
|---|---|
| ***E05F 3/00*** | (2006.01) |
| ***A47B 96/00*** | (2006.01) |
| ***E05F 1/12*** | (2006.01) |
| ***E05D 7/081*** | (2006.01) |
| *F25D 23/02* | (2006.01) |

(52) U.S. Cl.

CPC ..... *A47B 96/00* (2013.01); *E05D 7/081* (2013.01); *E05F 1/1253* (2013.01); *E05Y 2900/31* (2013.01); *F25D 23/028* (2013.01); *F25D 2323/024* (2013.01); *Y10T 16/304* (2015.01)

(58) Field of Classification Search

USPC ..... 16/49, 50, 54, 60, 61, 75, 85, DIG. 10

See application file for complete search history.

(56) References Cited

U.S. PATENT DOCUMENTS

| | | | | |
|---|---|---|---|---|
| 3,543,327 | A * | 12/1970 | Nilsson | 16/49 |
| 4,580,365 | A * | 4/1986 | Sieg | 49/336 |
| 4,686,739 | A * | 8/1987 | Fritsche et al. | 16/79 |
| 4,785,493 | A * | 11/1988 | Tillmann et al. | 16/53 |
| 5,802,670 | A * | 9/1998 | Bienek | 16/53 |
| 6,317,922 | B1 * | 11/2001 | Kondratuk | 16/72 |
| 6,393,664 | B1 | 5/2002 | Habegger et al. | |
| 6,442,795 | B1 * | 9/2002 | Chen | 16/53 |
| 6,845,545 | B2 * | 1/2005 | Han et al. | 16/277 |
| 7,921,511 | B2 * | 4/2011 | Johnson | 16/60 |
| 8,544,971 | B2 | 10/2013 | Stocker | |
| 8,732,904 | B2 * | 5/2014 | Busch | 16/53 |
| 2008/0127452 | A1 * | 6/2008 | Jackson | 16/50 |
| 2011/0113816 | A1 | 5/2011 | Stocker | |
| 2012/0233811 | A1 * | 9/2012 | Salutzki et al. | 16/54 |

* cited by examiner

*Primary Examiner* — Roberta Delisle

(74) *Attorney, Agent, or Firm* — Fay Sharpe LLP

(57) ABSTRACT

A door closure device includes a pivot pin adapted to engage an associated appliance hinge, and a channel rotatably connected to the pivot pin and adapted to be connected to an associated appliance door. A cam is non-rotatably engaged with the pivot pin. The cam comprises a lobed edge including a closing portion. A spring rod is slidably engaged with the channel, and a cam follower is operably engaged with the spring rod. A spring is engaged between the spring rod and the channel and biases the cam follower into engagement with the lobed edge of the cam. The follower moves along the lobed edge of the cam when the channel is rotated relative to the cam and the spring induces a door-closing torque on the channel when the follower is engaged with the closing portion of the cam lobed edge.

15 Claims, 9 Drawing Sheets

DOOR CLOSURE MECHANISM FOR REFRIGERATOR OR OTHER APPLIANCE

CROSS-REFERENCE TO RELATED APPLICATION

This application claims priority from and benefit of the filing date of U.S. provisional application Ser. No. 61/731,303 filed Nov. 29, 2012, and the entire disclosure of said provisional application is hereby expressly incorporated by reference into the present specification.

BACKGROUND

In the field of refrigerators and other appliances, it is often deemed desirable that the door close without additional user effort in certain circumstances to ensure that the door of the refrigerator or other appliance is properly closed even if a user neglects to close the door manually. In some cases, this is accomplished by orienting the appliance such that the door will close by gravity, at least when the door is located between the fully opened position and an intermediate, partially-closed position. These gravity operated door closing systems are sometimes effective, but they require that the appliance be properly installed and set-up to ensure proper closing. Gravity operated door closing systems can also cause the door to close with excessive force, which creates noise and can disturb the contents of the refrigerator or other appliance. These gravity operated systems also are often ineffective for modern French-Door refrigerators where the French doors must engage and operate sealing and/or latching flap or other similar mechanism located at the vertical seam where the two doors meet.

A need has been identified for a new and improved door closure device or mechanism for a refrigerator or other appliance that overcomes the above-noted deficiencies and others in a cost-effective and efficient manner that is suitable for modern design and manufacturing practices.

SUMMARY

In accordance with one aspect of the present development, a door closure mechanism for an appliance includes a body comprising first and second side walls that define a space therebetween. A spring rod is located in the space and is slidably engaged with the body. A follower is connected to the spring rod and a spring biases the spring rod to an extended position. A cam is connected to the body, and the body is rotatable relative to the cam. The cam includes a lobed edge including a closing portion, wherein the follower is biased into engagement with the lobed edge of the cam by the spring. A pivot pin is non-rotatably engaged with the cam, and comprises a portion that projects outwardly from the second side wall of the body and that is adapted to non-rotatably engage an associated structure. The follower moves along the lobed edge of the cam when said body is rotated relative to the cam and the spring induces a door-closing torque on the body when the follower is engaged with the closing portion of the cam lobed edge.

In accordance with another aspect of the present development, an appliance comprises a body and a door pivotally connected to the body by at least one hinge and movable between an opened position and a closed position relative to the body. A door closure mechanism is connected to the door. The door closure mechanism comprises a channel connected to the door. A spring rod is slidably engaged with the channel, and a cam follower is connected to the spring rod. A spring biases the spring rod to an extended position. A cam is non-rotatably engaged with the hinge, and the channel is rotatable relative to the cam about a pivot axis. The cam comprises a lobed edge including a closing portion. The follower is biased into engagement with the lobed edge of the cam by the spring and the follower moves along the lobed edge of the cam when the channel is rotated about the pivot axis during movement of said door between its opened and closed positions. The spring induces a door-closing torque on the channel when the follower is engaged with the closing portion of the cam lobed edge.

In accordance with a further aspect of the present development, a door closure device includes a pivot pin adapted to engage an associated appliance hinge, and a channel rotatably connected to the pivot pin and adapted to be connected to an associated appliance door. A cam is non-rotatably engaged with the pivot pin. The cam comprises a lobed edge including a closing portion. A spring rod is slidably engaged with the channel, and a cam follower is operably engaged with the spring rod. A spring is engaged between the spring rod and the channel and biases the cam follower into engagement with the lobed edge of the cam. The follower moves along the lobed edge of the cam when the channel is rotated relative to the cam and the spring induces a door-closing torque on the channel when the follower is engaged with the closing portion of the cam lobed edge.

DETAILED DESCRIPTION

The present development relates to a door closure device or mechanism for closing and/or otherwise controlling the opening and/or closing movement of an appliance door, such as a refrigerator door or the like. In general, the door closure mechanism works in conjunction with conventional door hinges that pivotally connect the appliance door to the body of the appliance.

Figure 1A:
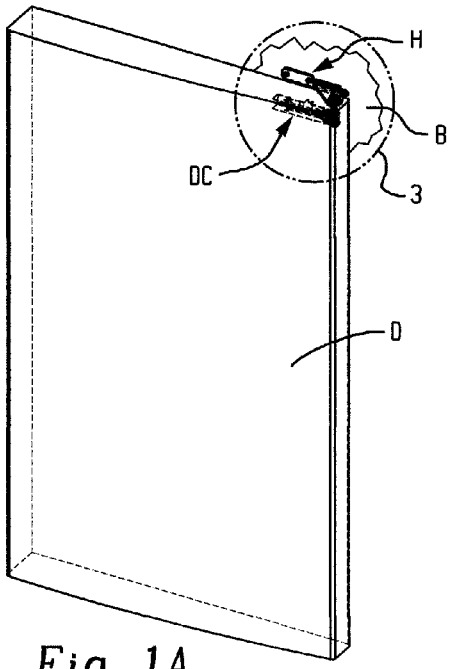
FIG. 1A partially shows an appliance such as a refrigerator including a door pivotally connected to a body by one or more hinges and comprising at least one door closure device or mechanism in accordance with the present development.
Figure 1C:
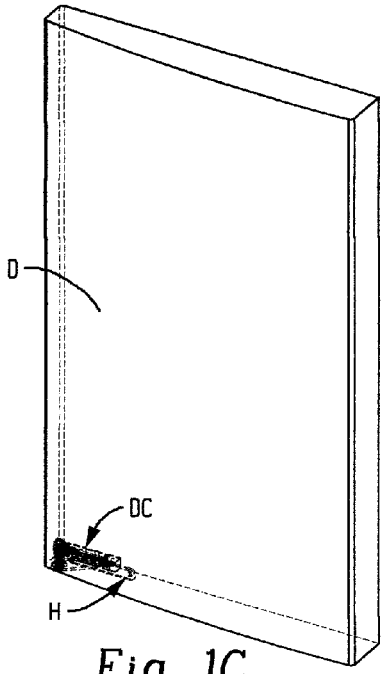
FIGS. 1B, 1C, 1D are similar to FIG. 1A but show the door closure mechanism mounted in additional or alternative locations.
Figure 1B:
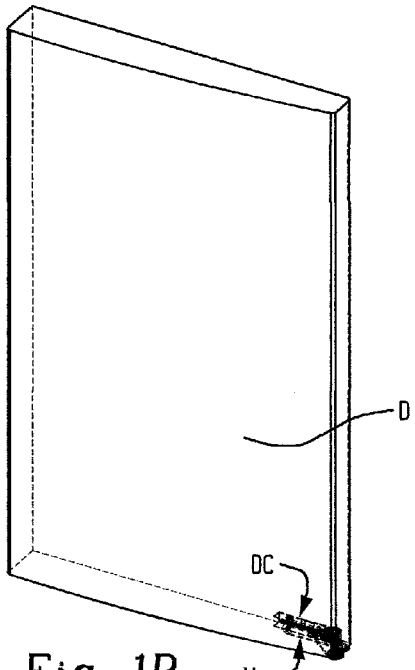
Figure 1D:
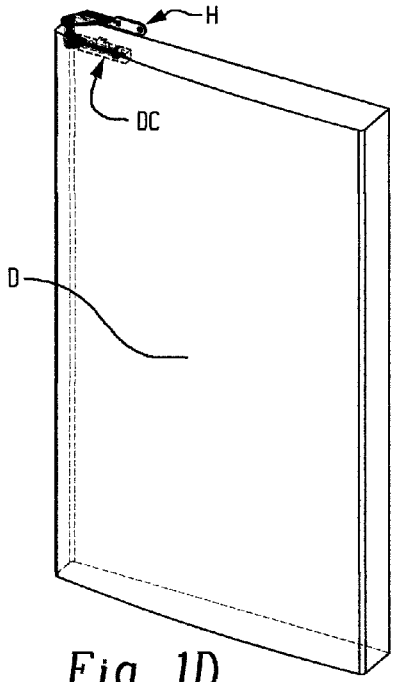
Figure 2A:
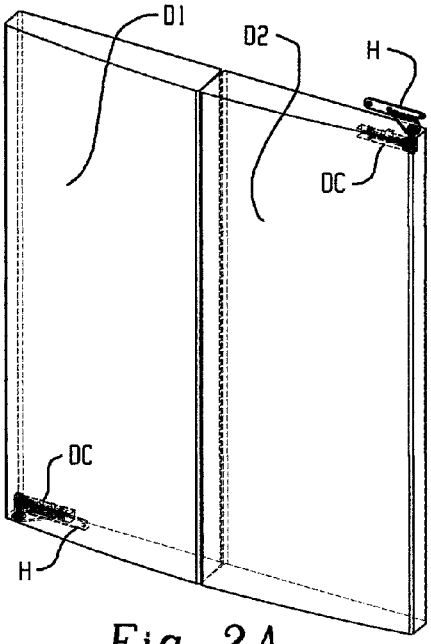
FIGS. 2A-2D show a set of French doors including a door closure mechanism in accordance with the present development.
Figure 2C:
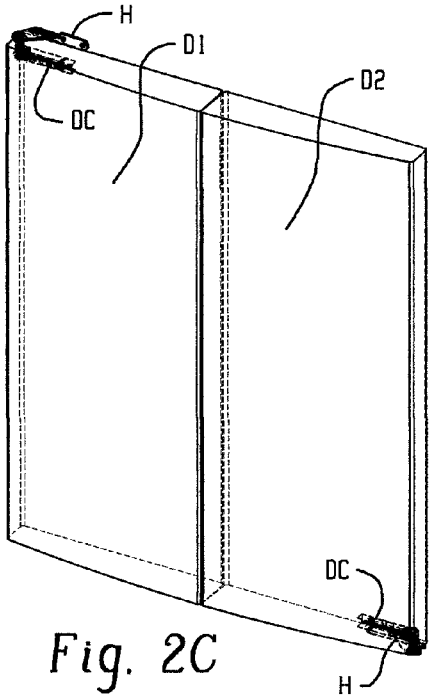
Figure 2B:
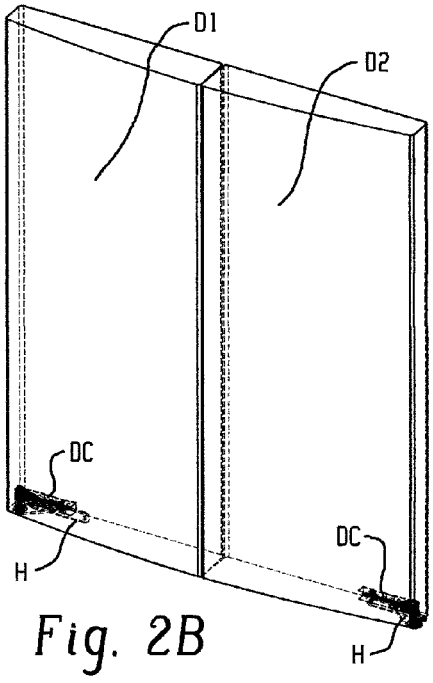
Figure 2D:
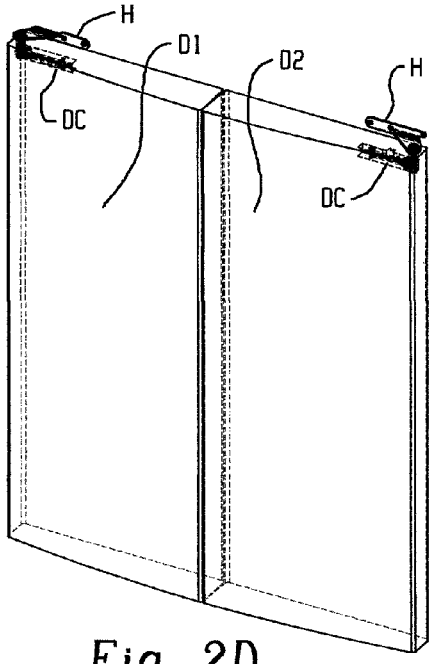

FIG. 1A partially shows an appliance such as a refrigerator comprising a body B and a door D that is pivotally connected to the body B by one or more hinges H (only one shown) that are typically located adjacent the upper and lower corners on the left or right lateral side the door D. In accordance with the present development, the door D comprises at least one door closure device or mechanism DC that is installed inside the door and located adjacent and operatively engaged with one of the hinges H in order to influence the pivoting movement of the door D on the hinges H, including urging the door D toward its closed position (shown) in which the door D lies parallel to a face of the appliance body B and closes the internal space of the refrigerator or other appliance. FIGS. 1B, 1C, 1D show the hinge H and door closure mechanism DC mounted in additional or alternative locations of the door D, and it is not intended that the present development be limited to any particular mounting location unless specified in a claim. The door D is pivotally movable relative to the appliance body B to and between a closed position and numerous opened positions, wherein the closed position of the door D is defined when door D lies parallel to a face of the appliance body B and closes an internal refrigeration or other space, and an opened position of the door D is defined when the door D is in any position other than the closed position.

FIGS. 2A-2D show the hinge H and door closure mechanism DC mounted to at least one or to each door D1,D2 of a set of French doors. The illustrated mounting arrangements for the hinges H and door closure mechanism DC are not intended to limit the present development in any way, and those of ordinary skill in the art will recognize that the hinges H and/or door closure mechanism DC can be mounted in alternative arrangements not shown herein.

Figure 3:
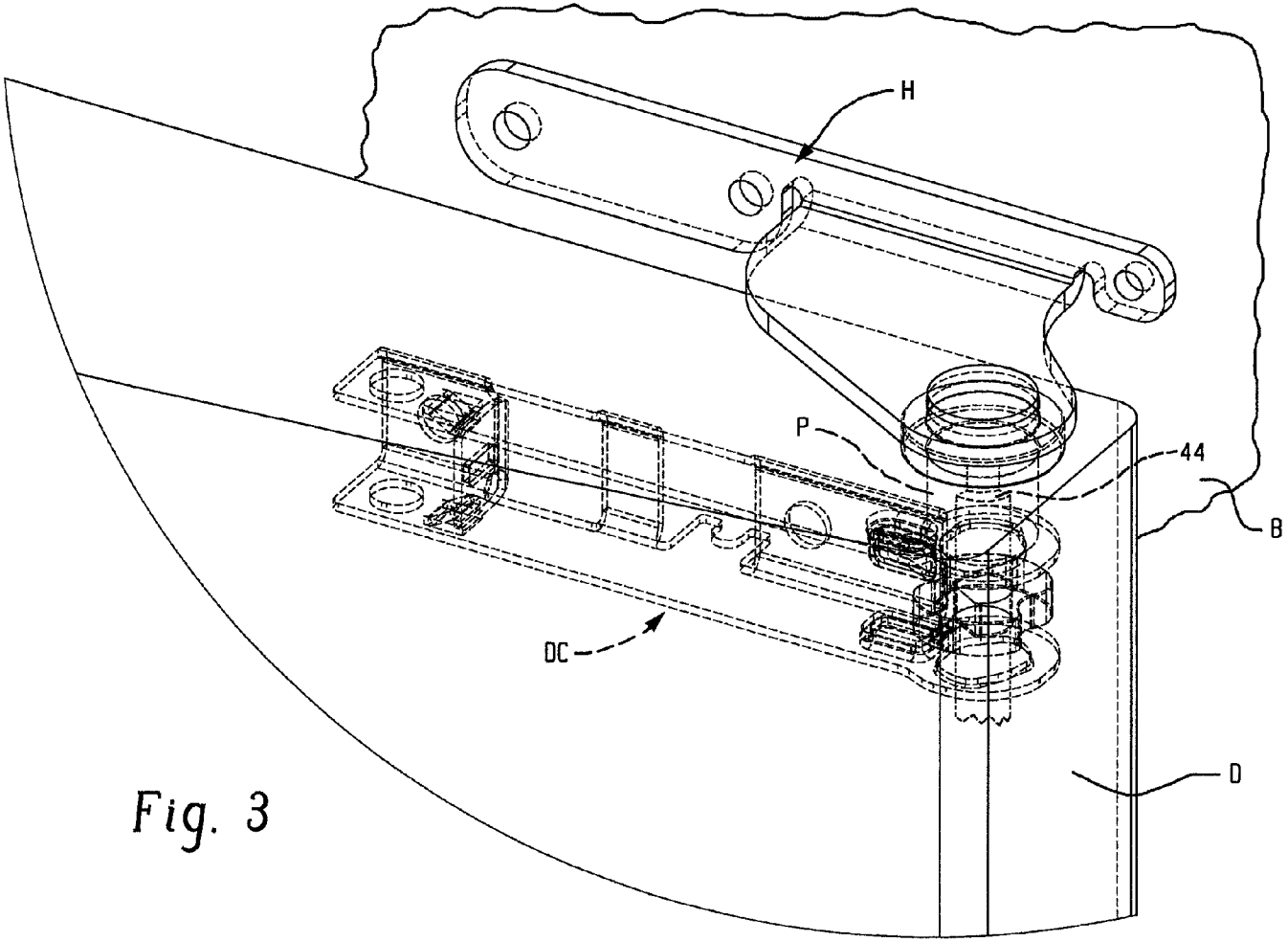
FIG. 3 is an enlarged view of detail portion 3 of FIG. 1A.

Regardless of the type of door D, a door closure mechanism DC according to the present development is operatively engaged with at least one of the door hinges H. FIG. 3 is an enlarged view of detail portion 3 of FIG. 1A. In FIG. 3, it can be seen that the hinge H comprises a non-rotatable pivot stud P that extends into the internal space of the door D and engages the door closure mechanism DC as described in further detail below. Alternatively, the pivot stud P is connected to another part of the appliance body B. It is not intended that the pivot stud P be limited to the structure shown herein, and it can be provided by any fixed part of the hinge H and/or body that can be engaged with the door closure mechanism DC as described below.

Figure 4A:
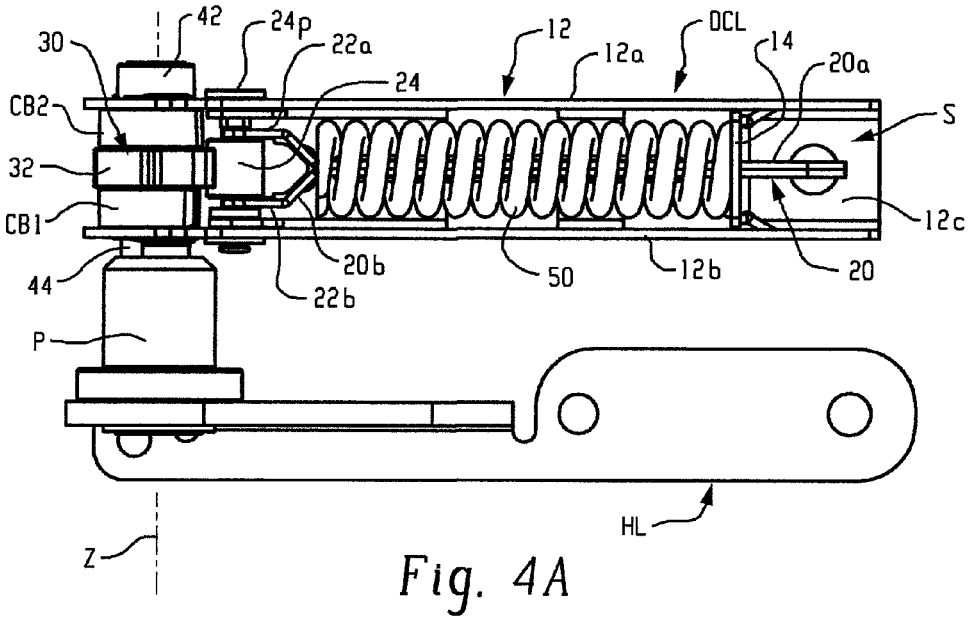
FIG. 4A is a front view of a left-hand door closure mechanism operatively engaged with a left-hand hinge.
Figure 4B:
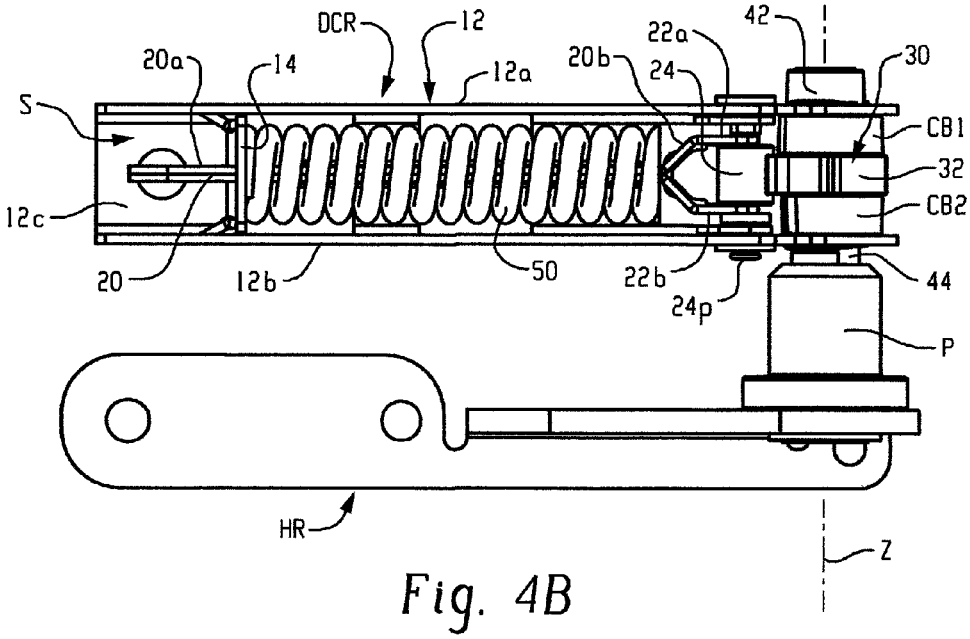
FIG. 4B is a front view of a right-hand door closure mechanism operatively engaged with a right-hand hinge.
Figure 5A:
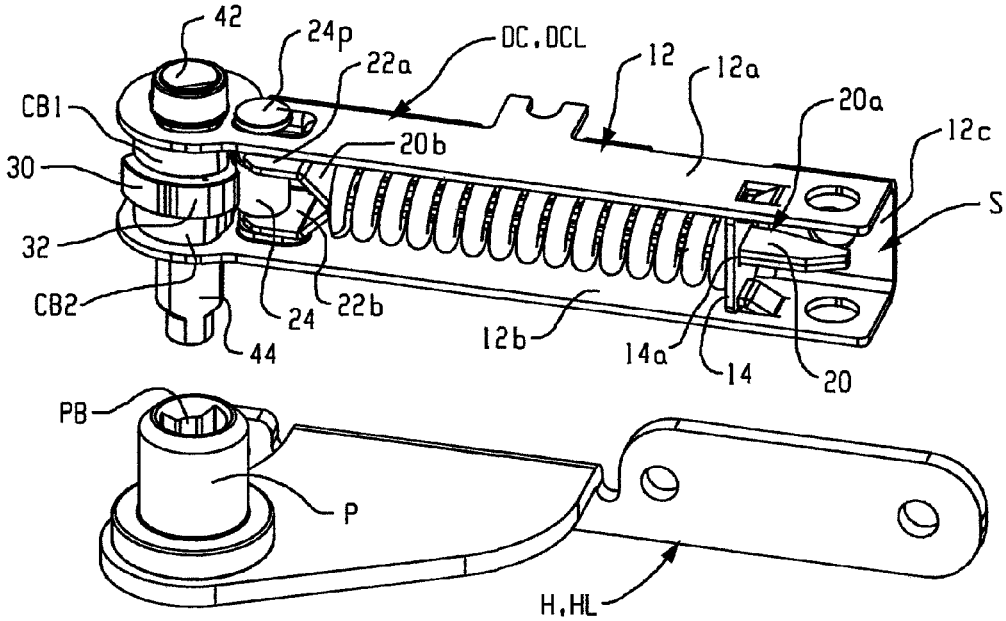
FIGS. 5A and 5B are exploded isometric views that correspond respectively to FIGS. 4A and 4B.
Figure 5B:
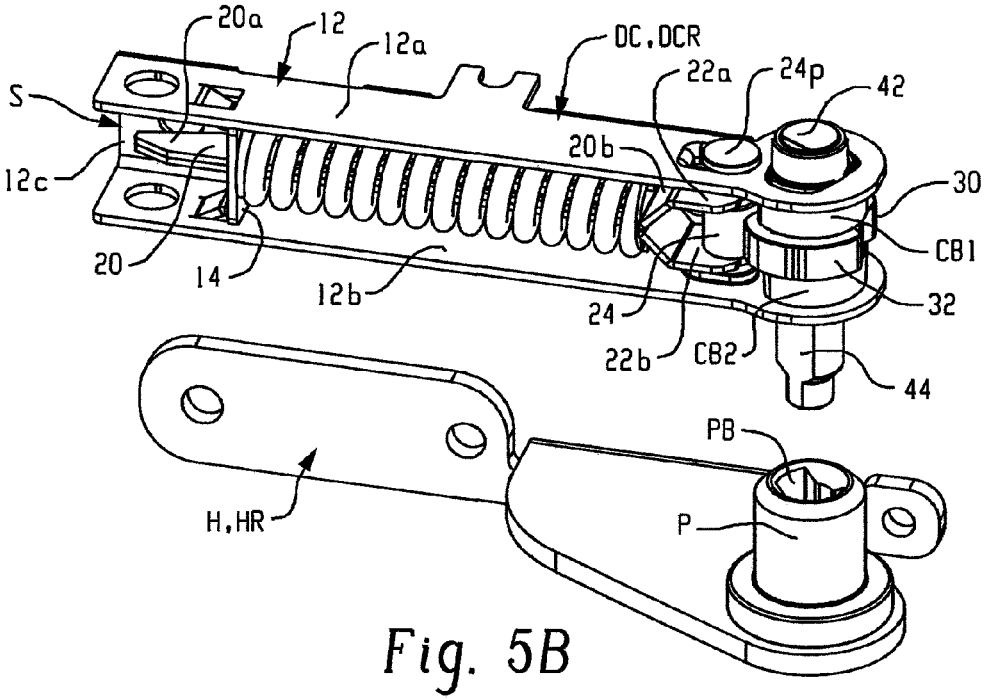
Figure 6:
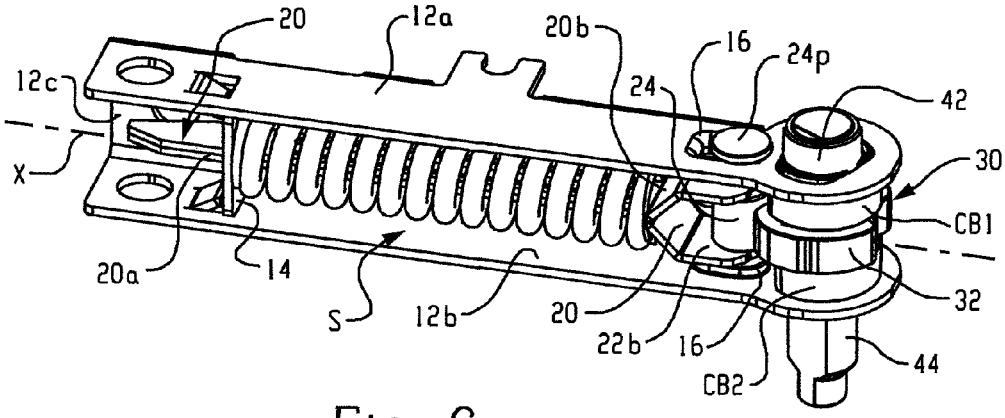
FIGS. 6 and 7 provide respective inner side and outer side isometric views of the door closure mechanism.
Figure 7:
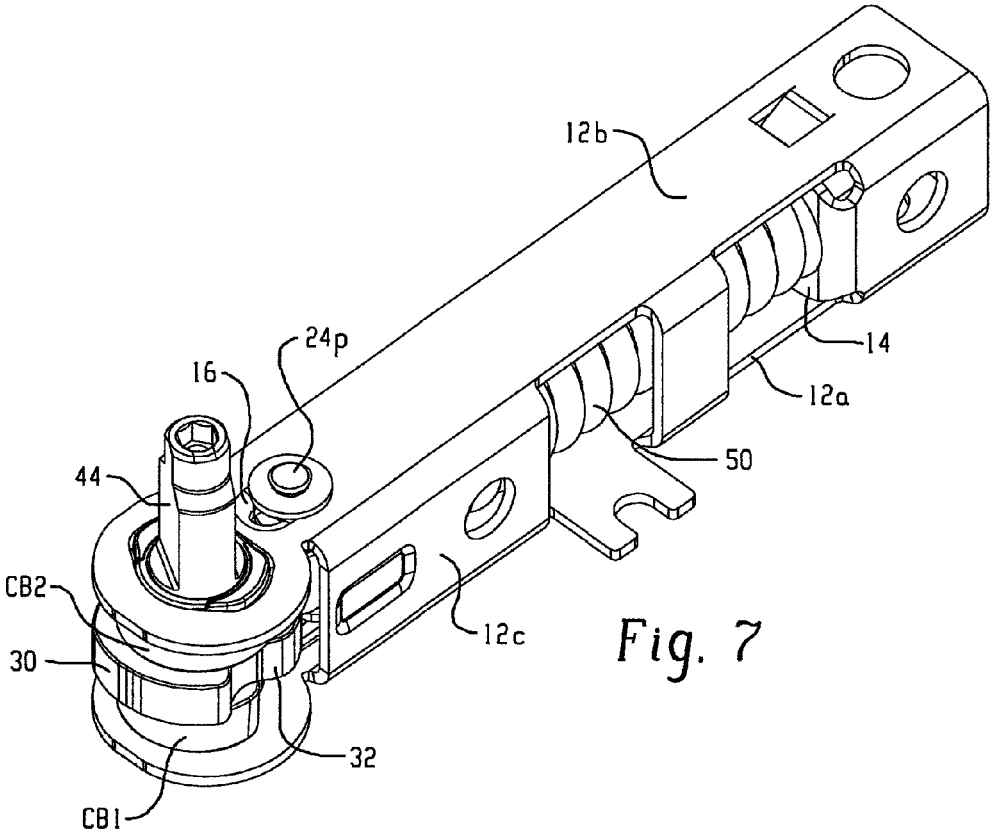
Figure 8A:
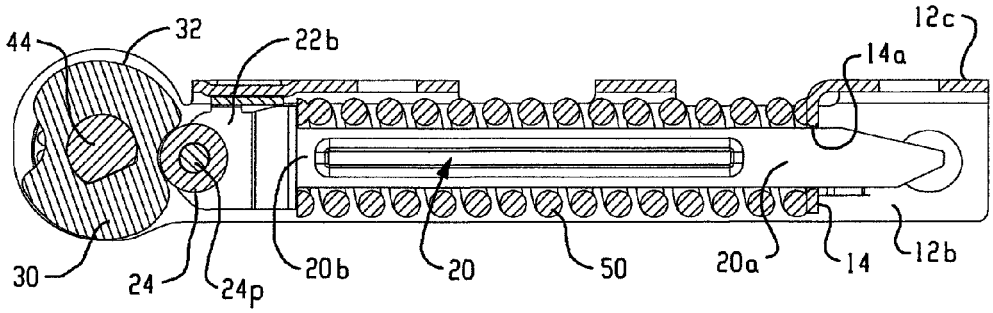
FIG. 8A is a section view taken at A-A of FIG. 8.
Figure 8:
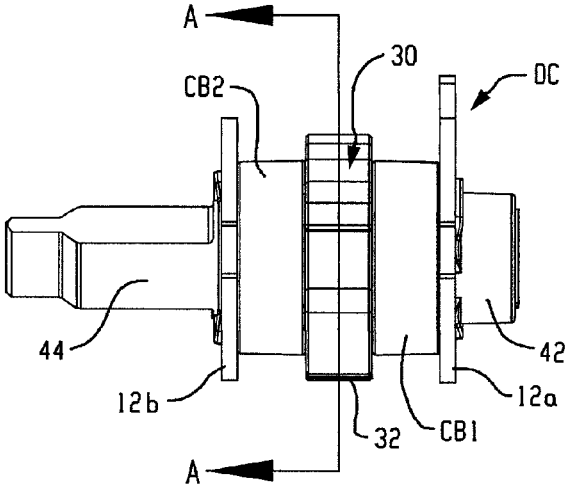
FIG. 8 is an end view of the door closure mechanism of FIGS. 6 and 7.
Figure 9A:
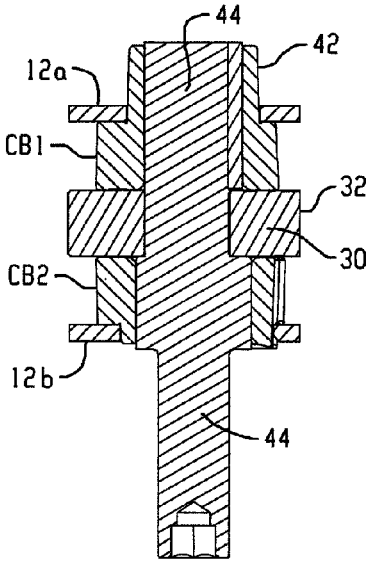
FIG. 9A is a section view taken at A-A in FIG. 9.
Figure 9:
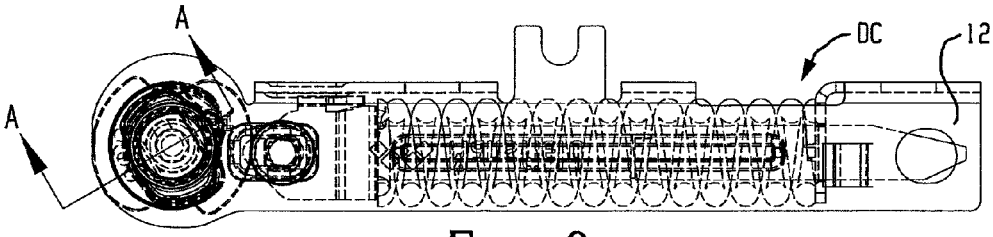
FIG. 9 is an outside plan view of the door closure mechanism.

FIG. 4A provides a front view of a left-hand door closure mechanism DC (DCL) operatively engaged with a left-hand hinge H (HL), and FIG. 4B provides a front view of a right-hand door closure mechanism DC (DCR) operatively engaged with a right-hand hinge H (HR). The left and right door closure mechanisms DCL,DCR are constructed as mirror images of each other. FIGS. 5A and 5B are exploded isometric views that correspond respectively to FIGS. 4A and 4B. FIGS. 6 and 7 provide respective inner side and outer side isometric views of the door closure mechanism DC. FIG. 8 is an end view of the door closure mechanism DC, and FIG. 8A is a section view taken at A-A in FIG. 8. FIG. 9 is an outside plan view of the door closure mechanism DC, and FIG. 9A is a section view taken at A-A in FIG. 9.

Referring to FIGS. 4A-9A, the door closure mechanism DC (DCL,DCR) comprises an elongated body channel 12 including a first or inner side wall 12*a* and a second or outer side wall 12*b* arranged in parallel, spaced-apart relation. The first and second side walls 12*a*,12*b* are each connected to and are interconnected to each other by a central wall 12*c*. The channel walls 12*a*,12*b*,12*c* define a space S therebetween. In one embodiment, the channel 12 is constructed as a one-piece metal stamping comprising a U-shaped cross-section, but it can be constructed of other materials and/or with other one-piece or multi-piece structures of varying shapes. A base wall 14 is located in and extends transversely through the space S between the side walls 12*a*,12*b*, preferably perpendicularly relative to the side walls 12*a*,12*b*. The base wall 14, which can be defined by a single or multi-piece wall structure, comprises a base wall aperture or slot 14*a* (FIGS. 5A, 8A) defined therein. In the illustrated embodiment, the base wall 14 is defined by a tab or other part of the central wall 12*c* of the channel 12 that is bent so as to extend into the space S between the side walls 14*a*,14*b*.

The door closure mechanism DC further comprises a spring rod 20 located in the channel space S between the side walls 12*a*,12*b* and slidably engaged with the body channel 12. A first or inner end 20*a* of the spring rod 20 extends through and is slidable in the base wall slot 14*a*. In the illustrated embodiment, the spring rod 20 and slot 14*a* are shaped to prevent rotation of the spring rod in the slot 14*a*. A second or outer end 20*b* of the spring rod 20 is bifurcated and comprises first and second legs 22*a*,22*b* between which a cam follower 24 is mounted by a rivet, pin, or other fastener 24*p* that extends between the legs 22*a*,22*b*, or the follower 24 is otherwise supported on the second end 20*b* of the spring rod 20. In the illustrated embodiment, the follower 24 comprises a roller that is rotatably supported on the second end 20*b* of the spring rod 20 by the pin 24*p*, but the follower 24 can alternatively be provided by a polymeric or other type of non-rotating slide-body. As such, the spring rod 20 is operably engaged with the cam follower 24. The channel side walls 12*a*,12*b* include respective slots 16 located therein that are aligned with each other, and the roller pin 24*p* also extends through both channel slots 16 so that the second end 20*b* of the spring rod 20 and the roller 24 are captured in the channel space S and are adapted to reciprocate in the space S along the longitudinal axis X (FIG. 6) of the spring rod 20 as limited by the length of the slots 16.

The door closure mechanism DC further comprises a cam 30 located in the space S between the side walls 12*a*,12*b* at a location spaced from the transverse base wall 14 and adjacent the roller 24. The body channel 12 is rotatable relative to the cam 30 as described below. In the illustrated embodiment, a top bushing CB1 is connected to and extends through the first side wall 12*a* into the space S adjacent the cam 30. A bottom bushing CB2 is connected to and extends through the side wall 12*b*, into the space S adjacent the cam 30. Top bushing CB1 and bottom bushing CB2 are arranged such that they secure the cam 30 in its operative position in the channel space S. The top bushing CB1 comprises a projection 42 that extends outwardly from the first (inner) side wall 12*a*. A pivot pin 44 extends between the side walls 12*a*,12*b* of the base channel 12, and the base channel 12 is rotatable relative to the pivot pin 44. In particular, the pivot pin 44 extends through the top bushing CB1, cam 30, and bottom bushing CB2. The pivot pin 44 extends outwardly from the second (outer) side wall 12*b*. The pivot pin 44 is adapted to be non-rotatably engaged with the pivot stud P or other structure of the hinge H that is fixed in location relative to the appliance body B. As shown in FIGS. 5A and 5B, the pivot stud P of the hinge H comprises a non-circular bore PB, and the pivot pin 44 comprises a stud portion including a corresponding non-circular cross section such that at least a part of the pivot pin 44 is closely and non-rotatably received in the non-circular bore PB of the hinge pivot stud P. The pivot pin 44 is keyed to the cam 30 or otherwise non-rotatably engaged with the cam 30 (see FIG. 8A), but the channel 12 is pivotable and pivots relative to the pivot pin 44 and the cam 30. Thus, when the door closure mechanism DC is operatively installed in a door D, the pivot pin 44 and the cam 30 are non-rotatably engaged with the pivot stud P or other fixed portion of the door hinge H, and the channel 12 is adapted to pivot with the door about the cam pivot pin 44 relative to the cam 30 when the appliance door D opens and closes relative to the appliance body B.

The cam 30 comprises a lobed portion or edge 32. The door closure mechanism DC further comprises a spring 50 or other means for biasing the spring rod 20 and roller 24 away from the base wall 14 to an extended position in which the roller 24 is engaged with the lobed edge 32 of the cam 30. As shown herein, the spring 50 comprises a helical coil spring 50 coaxially positioned about the spring rod 20, with its inner end 50*a* abutted or otherwise directly or indirectly engaged with the base wall 14 and its outer end 50*b* abutted with or otherwise directly or indirectly engaged with the bifurcated end 22*a*,22*b* or other portion of the spring rod 20 at a location spaced from the base wall 14 such that the spring 50 is operatively located between the roller 24 and the base wall 14. The spring 50 can be replaced by another type of spring and/or the spring 50 can be located alternatively. For example, the spring 50 can be located outside of the channel space S and the spring rod 20 correspondingly extended to protrude from the space S to be engaged directly or indirectly by the spring 50. When the channel 12 is pivoted with the appliance door D relative to the cam 30, the roller 24 rides along and follows the lobed edge 32 such that the spring rod 20 reciprocates in the channel space S toward and away from the cam 30 depending upon the contour of the lobed edge 32, while the roller 24 is continuously biased into engagement with the lobed edge 32 by the spring 50. As such, the spring rod 20 and roller or other follower 24 define a translating follower assembly. The lobed edge 32 is shaped in certain regions as described below such that the biasing force of the spring 50 is converted into a door closing moment or torque exerted on the channel 12 and thus on the door D.

Figure 10A:
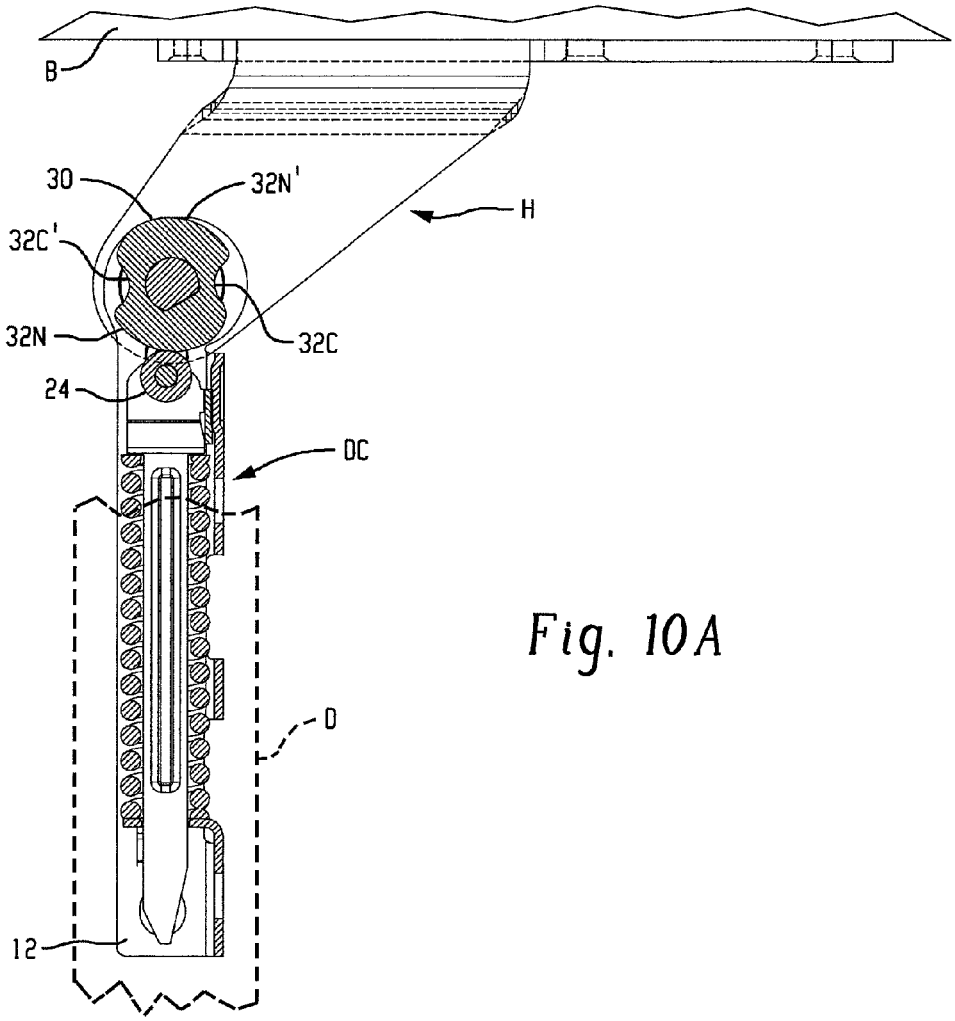
FIGS. 10A-10D are section views that show the door closure mechanism operatively installed within an appliance door that is located in various operative positions between and including fully closed and full opened.
Figure 10B:
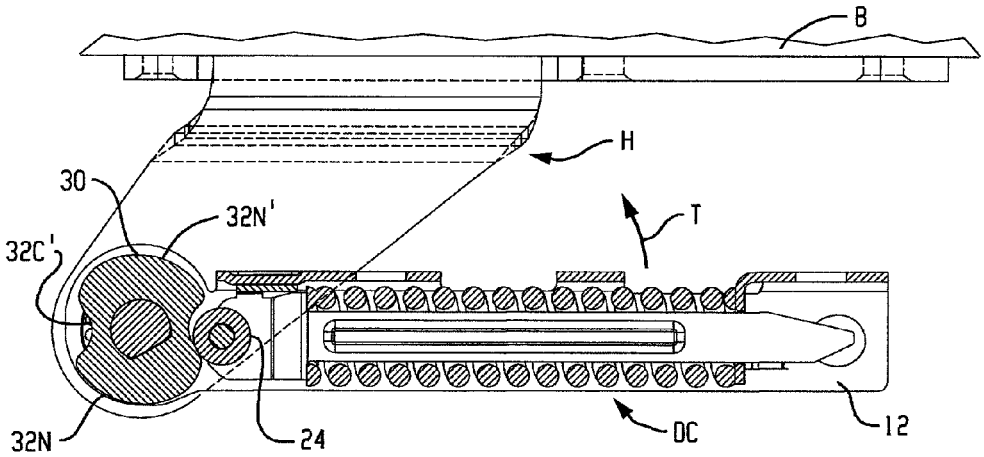
Figure 10C:
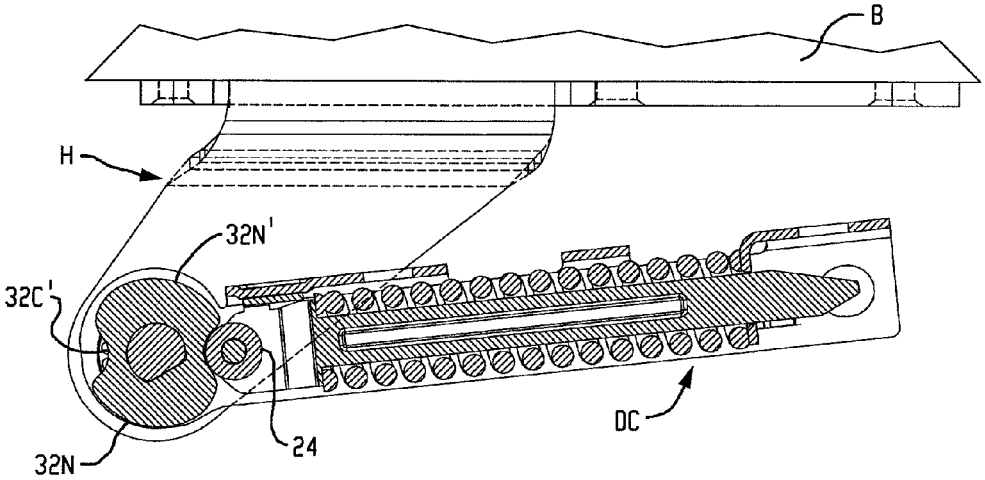
Figure 10D:
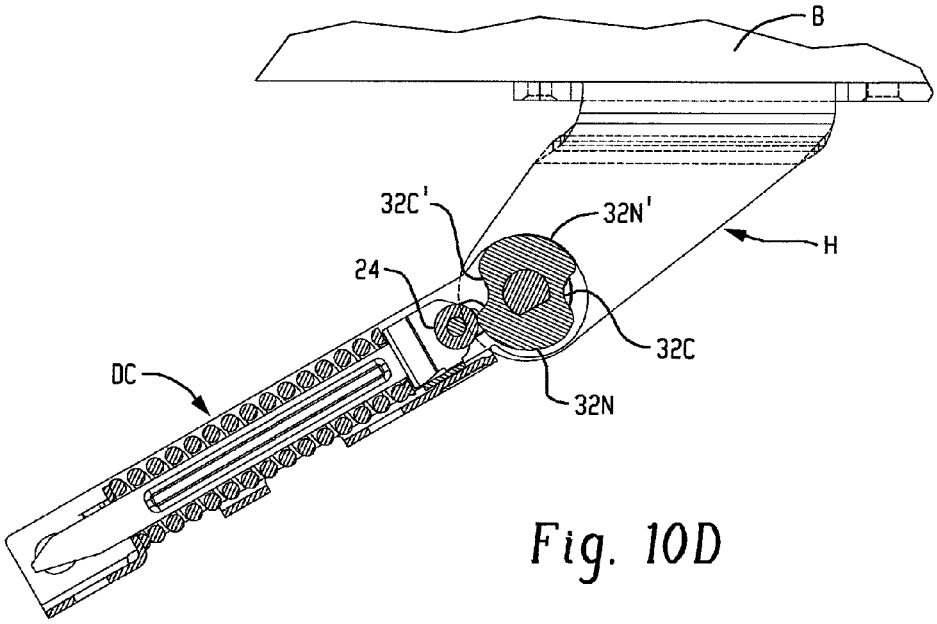

Operation of the door closure mechanism DC is further explained with reference to FIGS. 10A-10D, which are section views that are similar to FIG. 8A but show the door closure mechanism DC operatively installed within an appliance door D (FIG. 10A only) that is pivotally mounted on an appliance body B. It can be seen that the lobed edge 32 of the cam 30 includes a neutral portion 32N comprising an arcuate or otherwise smooth convexly curved portion. When the roller 24 is in contact with the neutral portion 32N as shown in FIG. 10A (an opened position of the appliance door D), the door closure mechanism DC exhibits substantially no opening or closing torque in/on the channel 12 and door D connected thereto ("substantially no opening or closing torque" as used herein means that the door D will not move in either direction without application of external force thereto). In one embodiment, the neutral portion 32N is defined by a circular arc segment centered on the pivot axis Z (FIGS. 4A & 4B) about which that channel 12 rotates relative to the cam 30. The lobed edge 32 further includes a closing portion 32C defined by a sloped or concave portion connected to a first or inner end of the neutral portion 32N and that slopes inward, as it extends away from the neutral portion 32N, toward the center of the cam 30 and inward toward the pivot axis Z (FIGS. 4A & 4B) about which that channel 12 rotates relative to the cam 30. As shown in FIG. 10B, when the roller 24 is located adjacent the neutral portion 32N but in contact with the closing portion 32C (a closed or partially closed position of the appliance door D), the roller 24 and spring 50 induce a closing moment or torque T in/on the channel 12 and the door D connected thereto. As shown in FIG. 10C, the closing portion 32C can be provided as a concave recess and when the roller 24 is fully seated in the concave closing portion 32C (if possible depending upon the structure of the appliance door D, body B and hinge H), an "overclosed" position of the appliance door D is defined. When the roller 24 is located in the "closed" position of FIG. 10B (with the roller 24 only partially seated in the concave closing portion 32C of the cam 30), the door closure mechanism DC will seek to move to the overclosed position of FIG. 10C due to the closing moment/torque T, which ensures that the appliance door D is continuously urged in the closing direction toward the closed position when the appliance door is already closed or nearly closed. FIG. 10D shows a fully opened position for the appliance door D in which the door D is opened to a maximum possible extent as limited by the hinge H. If desired, the cam 30 is made symmetrical and includes a second neutral portion 32N' defined as an identical mirror image of neutral portion 32N and a second concave or otherwise shaped closing portion 32C' defined as an identical mirror image of the first closing portion 32C, such that the cam 30 can be installed in first and second orientations between the side walls 12*a*,12*b* (either side up) without affecting its functionality. Alternatively, depending on the structure of the hinge H, the second concave portion 32C' can function as a dwell point for the roller 24 so that the door is held opened when opened more than the position shown in FIG. 10D and the roller 24 seats partially or fully in the second concave portion 32C'.

Other modifications and alterations will occur to those of ordinary skill in the art to which the invention pertains upon reading and understanding this specification. It is intended that the present invention be construed as encompassing all such modifications and alterations.

The invention claimed is:

1. A door closure mechanism for an appliance door, said door closure mechanism comprising:

a body comprising first and second side walls that define a space therebetween;

a spring rod located in the space and slidably engaged with said body;

a follower connected to the spring rod;

a spring that biases the spring rod to an extended position;

a cam connected to said body, wherein said body is rotatable relative to said cam, said cam comprising a lobed edge including a closing portion, wherein said follower is biased into engagement with said lobed edge of said cam by said spring;

a pivot pin non-rotatably engaged with the cam and comprising a portion that projects outwardly from said second side wall of said body that is adapted to non-rotatably engage an associated structure;

said first and second side walls of said body comprising respective first and second slots that are aligned with each other, wherein said follower is connected to said spring rod by a fastener that extends through and between said first and second slots such that said fastener captures said follower in said space between said first and second side walls;

wherein said follower moves along said lobed edge of said cam when said body is rotated relative to said cam and said spring induces a door-closing torque on said body when said follower is engaged with said closing portion of said cam lobed edge.

2. The door closure mechanism as set forth in claim 1, wherein said follower comprises a roller rotatably connected to said spring rod by said fastener.

3. The door closure mechanism as set forth in claim 2, wherein said spring rod comprises a bifurcated end including first and second legs between which said roller is located.

4. The door closure mechanism as set forth in claim 1, wherein said body comprises a base wall located in said space between said first and second side walls, and said spring rod extends through an aperture defined in said base wall.

5. The door closure mechanism as set forth in claim 4, wherein said spring comprises a coil spring through which said spring rod coaxially extends, wherein a first end of said spring is engaged with said base wall and a second end of said spring is engaged with said spring rod.

6. The door closure mechanism as set forth in claim 1, wherein said cam further comprises a second closing portion that is identical to said first closing portion and said lobed edge of said cam is symmetrically defined to include first and second neutral portions located between said first and second closing portions such that said cam can be installed in either of first or second orientations without changing its functionality.

7. An appliance comprising:

a body;

a door pivotally connected to the body by at least one hinge and movable between an opened position and a closed position relative to said body;

a door closure mechanism connected to said door, said door closure mechanism comprising:

a channel connected to said door, said channel comprising first and second side walls that define a space therebetween, and a base wall located between said first and second side walls;

a spring rod slidably engaged with said channel, wherein a first portion of said spring rod is slidably engaged with an aperture defined in said base wall;

a cam follower connected to the spring rod;

a spring that biases the spring rod to an extended position;

a cam non-rotatably engaged with said hinge, wherein said channel is rotatable relative to said cam about a pivot axis, said cam comprising a lobed edge including a closing portion;

said first and second side walls of said channel comprising respective first and second slots that are aligned with each other, wherein said follower is connected to a second portion of said spring rod by a fastener that extends through and between said first and second slots such that said fastener captures said second portion of said spring rod in said space between said first and second side walls;

wherein said follower is biased into engagement with said lobed edge of said cam by said spring and said follower moves along said lobed edge of said cam when said channel is rotated about said pivot axis during movement of said door between its opened and closed positions, and wherein said spring induces a door-closing torque on said channel when said follower is engaged with said closing portion of said cam lobed edge.

8. The appliance as set forth in claim 7, wherein said follower remains engaged with said closing portion of said cam lobed edge when said door is located in said closed position such that said door closure mechanism urges said door toward said closed position when said door is located in said closed position.

9. The appliance as set forth in claim 8, wherein said lobed edge of said cam further comprises a neutral portion located adjacent said closing portion and comprising a convexly curved circular arc segment centered on the pivot axis, wherein said door closure mechanism exerts substantially no opening or closing torque on said door when said cam follower is engaged with said convexly curved circular arc segment.

10. The appliance as set forth in claim 7, wherein said follower comprises a roller rotatably connected to said spring rod by said fastener.

11. The appliance as set forth in claim 10, wherein said second portion of said spring rod comprises a bifurcated structure including first and second legs between which said roller is located.

12. The appliance as set forth in claim 7, wherein said spring comprises a coil spring through which said spring rod coaxially extends, wherein a first end of said spring is engaged with said base wall and a second end of said spring is engaged with said spring rod.

13. The appliance as set forth in claim 12, wherein said cam is secured between said first and second side walls by a pivot pin that projects outwardly from said second side wall of said channel, said pivot pin non-rotatably engaged with said cam and non-rotatably engaged with said hinge such that said channel rotates relative to said cam about said pivot axis when said door moves between said opened and closed positions.

14. The appliance as set forth in claim 13, wherein said lobed edge of said cam is symmetrically defined to include first and second identical closing portions such that said cam is mountable in first and second orientations without a change in its functionality.

15. A door closure device comprising:

a pivot pin adapted to engage an associated appliance hinge;

a channel rotatably connected to said pivot pin and adapted to be connected to an associated appliance door, said channel comprising first and second side walls that define a space therebetween;

a cam non-rotatably engaged with said pivot pin, said cam comprising a lobed edge including a closing portion;

a spring rod slidably engaged with said channel;

a cam follower operably engaged with the spring rod;

a spring engaged between the spring rod and the channel and biasing the cam follower into engagement with the lobed edge of the cam;

said first and second side walls of said channel comprising respective first and second slots that are aligned with each other, wherein said cam follower is connected to said spring rod by a fastener that extends between said first and second slots such that said fastener captures said follower in said space between said first and second side walls:

wherein said follower moves along said lobed edge of said cam when said channel is rotated relative to said cam and said spring induces a door-closing torque on said channel when said follower is engaged with said closing portion of said cam lobed edge.

* * * * *